US010316480B2

(12) United States Patent
Kemmerling et al.

(10) Patent No.: US 10,316,480 B2
(45) Date of Patent: Jun. 11, 2019

(54) ADJUSTABLE SNOW PLOW

(71) Applicant: Meyer Products, LLC, Cleveland, OH (US)

(72) Inventors: Craig Kemmerling, Twinsburg, OH (US); Denis Sankovic, Euclid, OH (US); Thomas Miller, Waterloo, IN (US)

(73) Assignee: Meyer Products, LLC, Cleveland, OH (US)

( * ) Notice: Subject to any disclaimer, the term of this patent is extended or adjusted under 35 U.S.C. 154(b) by 0 days.

(21) Appl. No.: 15/235,725

(22) Filed: Aug. 12, 2016

(65) Prior Publication Data

US 2017/0044730 A1 Feb. 16, 2017

Related U.S. Application Data

(60) Provisional application No. 62/204,024, filed on Aug. 12, 2015.

(51) Int. Cl.
*E01H 5/06* (2006.01)

(52) U.S. Cl.
CPC ..... *E01H 5/067* (2013.01); *E01H 5/06* (2013.01)

(58) Field of Classification Search
CPC ..... E02F 3/8155; E02F 3/815; E01H 5/065
See application file for complete search history.

(56) References Cited

U.S. PATENT DOCUMENTS

| | | | | |
|---|---|---|---|---|
| 4,073,077 | A | 2/1978 | Essel et al. | |
| 4,369,847 | A | 1/1983 | Mizunuma | |
| 5,285,588 | A * | 2/1994 | Niemela | E01H 5/065 37/232 |
| 5,392,538 | A | 2/1995 | Geerligs et al. | |
| 5,595,007 | A | 1/1997 | Biance | |
| 6,408,548 | B1 | 6/2002 | Altheide | |
| 8,887,413 | B2 | 11/2014 | Miller | |
| 2015/0068780 | A1 | 3/2015 | Miller | |
| 2015/0308060 | A1 * | 10/2015 | Beaird, III | E01H 5/065 37/231 |

* cited by examiner

*Primary Examiner* — Tara Mayo-Pinnock
(74) *Attorney, Agent, or Firm* — Emerson Thomson Bennett; Roger D. Emerson; Nicholas J. Bagnolo

(57) ABSTRACT

An adjustable snow plow having a center unit; at least one extender wing; a square channel connected to said center unit; at least one mounting bracket connected to said center unit wherein the at least one extender wing is connected to the center unit via the square channel, and the mounting bracket is selectably attachable to a vehicle.

The adjustable snow plow is able to vary the width of the plow blade so as to accommodate a number of different locations for which snow may need to be removed. The adjustable plow may be a straight blade plow, or a partially straight blade plow that allows for the user of the adjustable plow to dictate in which direction the desired snow is displaced.

20 Claims, 3 Drawing Sheets

ADJUSTABLE SNOW PLOW

TECHNICAL FIELD

The present invention relates to an apparatus and method for snow removal. More particularly, the present invention is directed at a snow plow whose working width can be adjusted to accommodate various sized areas in need of snow removal.

BACKGROUND

Snow plows are frequently used as snow removal devices in the winter months in cold climates. Snow removal is often desirable for people to be able to travel efficiently. Sometimes entities will need to keep several different sized snow plows in their equipment inventory to accommodate various sized jobs, such as driveways, parking lots, streets, and sidewalks. This is disadvantageous, as each snow plow has associated costs including the purchase price, maintenance and storage. In addition, there are various types of plows, e.g. most snow plows will displace snow to the side, so the result is that there is a pile of plowed snow that is parallel to the direction of travel of the plow. Other types of snow removal apparatuses, sometimes called "containment plows", capture the snow and transport it without the transverse displacement associated with "straight blade plows."

What is needed is a cost-effective snow plow apparatus that can accommodate all of the needs of the different sized areas that need to be plowed, and can remove the snow such that there is no residual snow that can cause additional access problems.

SUMMARY

Provided is a an adjustable snow plow having a center unit; at least one extender wing; a square channel connected to said center unit; at least one mounting bracket connected to said center unit wherein the at least one extender wing is connected to the center unit via the square channel, and the mounting bracket is selectably attachable to a vehicle.

DETAILED DESCRIPTION

Figure 1:
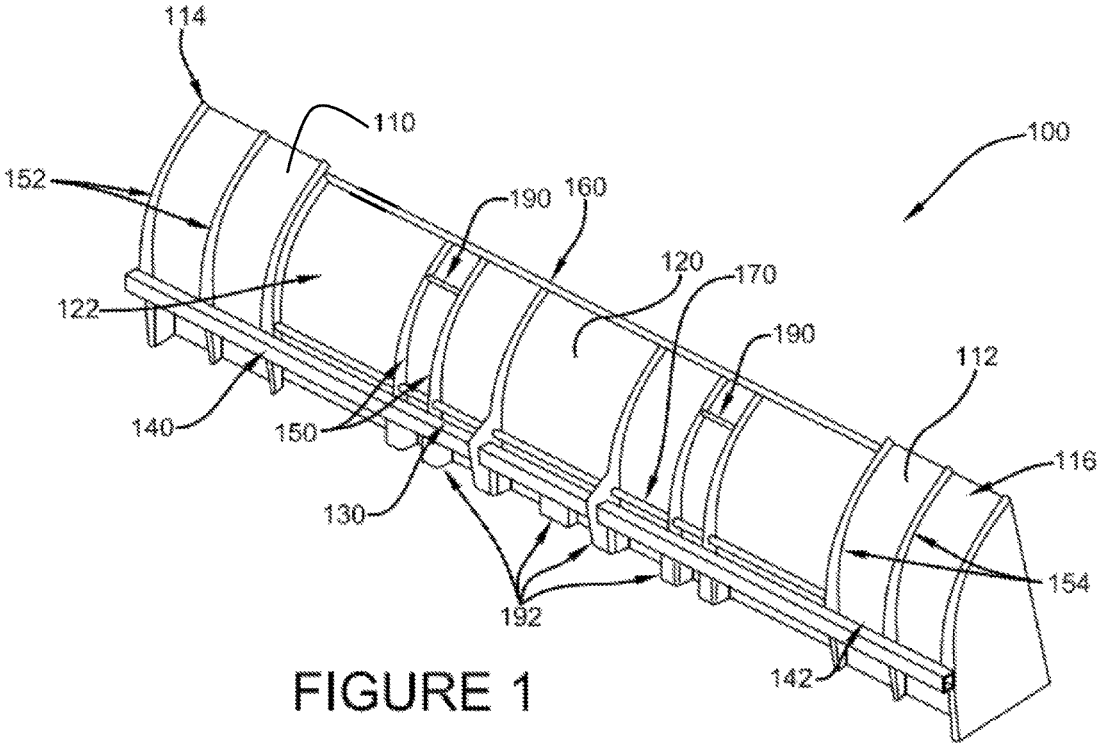
FIG. 1 is an embodiment of an adjustable plow in the extended position.

With reference to FIG. 1, a perspective view of an embodiment of the rear of an adjustable plow 100 in an extended position is shown wherein extender wings 110 and 112 can be attached to the center unit 120, and can be extended toward the distal ends of center unit 120 to achieve a maximum width of adjustable plow 100. Center unit 120 can consist of a curved region 122 between the top edge 160 and a lateral support member 170. Center unit 120 can have a horizontally mounted square channel 130 on its rearward side into which extender wing bars 140 and 142 can appropriately slide.

According to one embodiment, the extender wing bars 140 and 142 are able to slide about the horizontally mounted square channel 130 so that the extender wing bars 140 and 142 move away from each other so as to increase the overall width of the plow 100. According to another embodiment, the extender wing bars 140 and 142 are able to slide about the horizontally mounted square channel 130 so that the extender wing bars 140 and 142 move towards each other so as to decrease the overall width of the plow 100. According to a further embodiment, the extender wing bars 140 and 142 are able to slide about the horizontally mounted square channel 130 independently from one another so as to vary the overall width of the plow 100.

With continued reference to FIG. 1, the center unit 120 can also have support columns 150 that can extend from a top edge 160 of the center unit 120 to the bottom of center unit 120. Likewise, extender wings 110 and 112 can have support columns 152 and 154 respectively. Extender wings 110 and 112 can have curved regions 114 and 116 respectively, which will each align with center unit curved region 122.

Figure 2:
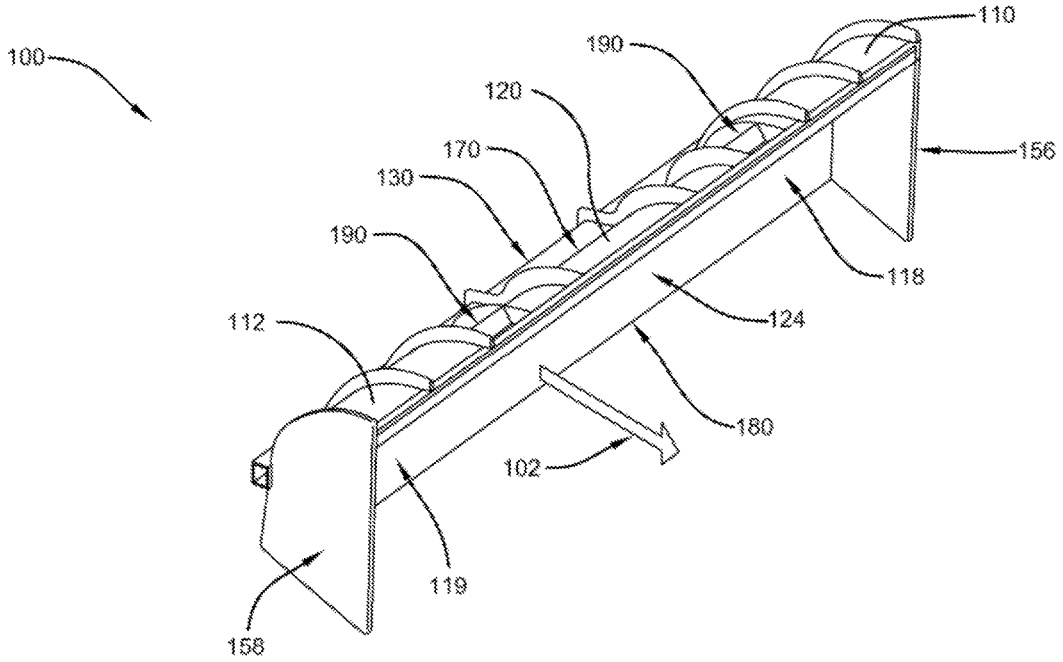
FIG. 2 is an embodiment of an adjustable plow in the retracted position.

With reference to FIG. 2, a perspective view of the front of the adjustable plow 100 in a retracted position, an embodiment of an adjustable plow 100 is shown wherein extender wings 110 and 112 can be retracted inward towards the center of center unit 120 to achieve a minimum width. Center unit 120 can consist of a non-curved, substantially vertical region 124 between the bottom edge 180 and the lateral support member 170. Extender wings 110 and 112 can have non-curved, substantially vertical regions 118 and 119 respectively, which will each align with center unit non-curved, substantially vertical region 124.

According to one embodiment, extender wings 110 and 112 can have side containment plates 156 and 158 respectively. The side containment plates 156 and 158 are capable of containing the desired amount of snow within the limits of the plow 100. According to one embodiment, the side containment plates 156 and 158 are fixed to the end of extender wings 110 and 112 respectively in a manner that does not allow them to move other than with the horizontal extension of the extender wings 110 and 112. According to another embodiment, the side containment plates 156 and 158 are fixed about a vertical axis that allows them to pivot longitudinally about said vertical axis. This allows for the side containment plates 156 and 158 to be oriented at any angle, relative to the substantially vertical region 124, between 90° and 180° . When the side containment plates are rotated so as to be in the same plane as that of the substantially vertical region 124 (180°), the overall width of the plow 100 is increased by the respective length of each side containment plate 156 or 158 that is so extended.

Figure 3:
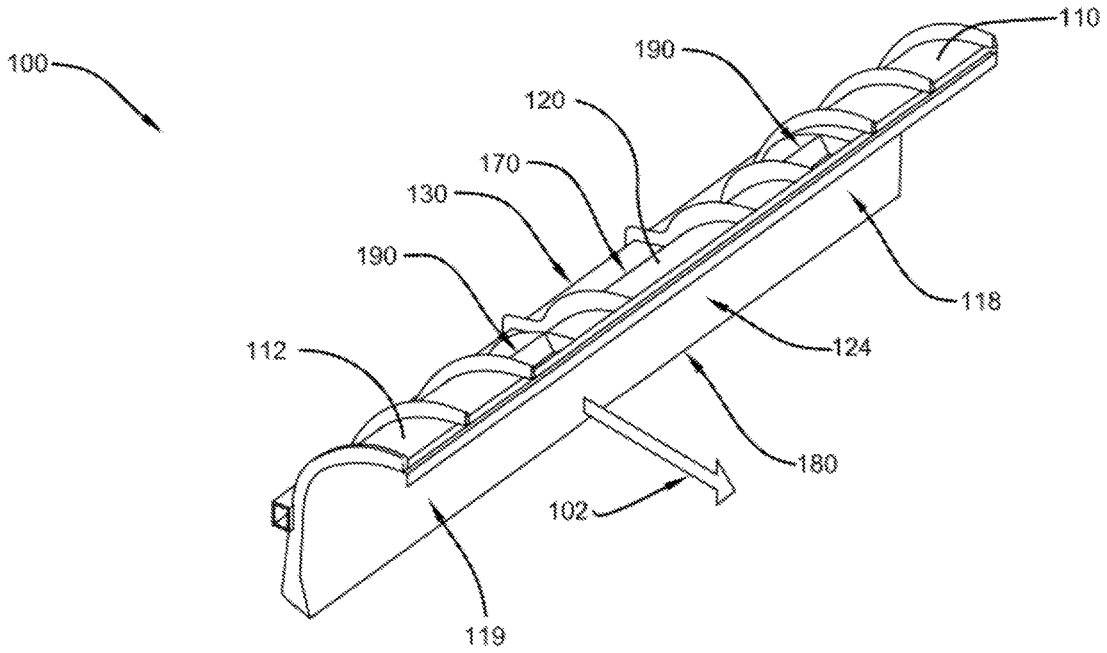
FIG. 3 is an additional embodiment of an adjustable plow without containment plates.

With reference to FIG. 3, another embodiment of the plow 100 is shown in a perspective view such that the plow 100 is able to consist of a center unit 120 and extender wings 110 and 112, wherein there are no containment plates on either of the respective distal ends of the extender wings 110 and 112. Extender wings 110 and 112 can have non-curved, substantially vertical regions 118 and 119 respectively, which will each align with center unit non-curved, substantially vertical region 124. In this embodiment, snow can be displaced to the side of the plow 100.

With reference to FIG. 1, according to this embodiment, the center unit 120 can be operatively attached to a vehicle such as a truck, ATV, skid steer, or the like, via upper mounting brackets 190 and lower mounting brackets 192. According to one embodiment, the upper mounting brackets 190 and lower mounting brackets 192 are able to be attached directly to the vehicle. According to another embodiment, the upper mounting brackets 190 and lower mounting brackets 192 are able to be attached to at least one hydraulic actuator which may be attached to a vehicle or frame member on the opposing end. The at least one hydraulic actuator may act to secure the plow 100 to the vehicle, as well as provide the plow 100 with the ability to rotate, adjust, or be manipulated to a desired angle or orientation for plowing purposes. According to another embodiment, the upper mounting brackets 190 and lower mounting brackets 192 are able to be selectively attached to a frame, such as an A-frame, lift frame, or any other type of frame commonly known and used by those skilled in the art.

According to this embodiment, the any type of frame commonly known and used by those skilled in the art is capable of manipulating the angle, orientation, or any other physical positioning of the plow 100. This may include motions such as raising, lowering, or rotating the plow blade. Further manipulation associated with this embodiment may include any type of movement which allows the plow 100 to be positioned relative to the vehicle to which the plow 100 may be selectably attached which is commonly known and used by those skilled in the art. According to one embodiment, the upper mounting brackets 190 and lower mounting brackets 192 are operatively attached by way of at least one pin that is placed through an opening of the respective mounting bracket. Each of mounting brackets 190 and 192 are capable of securely receiving such a pin, or other like device, so as to affix the plow 100 to the desired device. According to another embodiment, a hinge, flange, or any other type of pivotal fastening device may be used to attach the plow 100 to the desired location by way of upper mounting brackets 190 and lower mounting brackets 192. According to this embodiment, the means of attachment are such that the plow 100 is able to rotate according to the action of the frame, vehicle, hydraulic actuator, manual force, or any other means capable of adjusting or altering the relative position of the plow 100.

According to one embodiment, the orientation of the plow blade relative to the vehicle or frame to which it is attached remains in a primarily horizontal position such that the opposing ends of the plow blade which contain extender wings 110 and 112 are perpendicular to the direction of travel of the vehicle. The mounting brackets 190 and 192 can be operatively attached to the desired structure in such a way that can allow the plow 100 to be raised, lowered, or angled about an axis substantially defined by the square channel 130 as desired. According to this embodiment, each of the distal ends of the plow 100 are raised or lowered together such that they remain in the same horizontal plane as one another.

According to one embodiment, the angle of the plow 100 is able to be adjusted according to the contour of the ground below so as to allow the plow blade to remain level with the ground. According to another embodiment, the level of the plow blade is capable of being raised above the surface of the ground. This embodiment allows for the plow 100 to undergo transportation while remaining attached to the vehicle by raising the entire plow 100 in the vertical direction so that the plow 100 is no longer in contact with the ground. According to this embodiment, the plow 100 is able to avoid any unwanted plowing or impending collisions with obstacles below, or may be used for any other purpose that may require the raising of the blade of the plow 100 above the level of the ground. According to another embodiment, the plow 100 is able to be lowered in the opposite manner of the raising motion described above, so as to accommodate any surface that may require such a declination of the plow 100.

According to one embodiment, the extender wings 110 and 112 can be operatively attached to an automatic controller so as to allow an operator to selectively position the extender wings 110 and 112 to a desired horizontal position along square channel 130, thus achieving a desired width of the plow 100. According to another embodiment, the distance at which the extender wings 110 and 112 are positioned is done so manually, or by any other means currently known and practiced by those skilled in the art.

With reference to FIG. 3, the selective operation of the width of the extender wings 110 and 112 allows the plow 100 to be adjusted to effectively remove snow from surfaces of varying widths, such as sidewalks, driveways, and wider areas such as parking lots. The width of each of extender wings 110 and 112 can independently vary from approximately one foot to approximately three feet, depending on the overall size of the plow 100. According to one embodiment, each of extender wings 110 and 112 are the same width.

With continued reference to FIG. 3, the effective width of the plow 100 can vary across a wide range. According to one embodiment, the effective width of the plow 100 is able to be as narrow as approximately one foot. This embodiment is achieved when each of the extender wings 110 and 112 is retracted to the fullest extent allowed by the square channel 130 so as to position the extender wings 110 and 112 so that they overlap each other, or cover the same effective area. According to this embodiment, the width of the plow 100 is the same as that of the substantially vertical region 124. According to this embodiment, the width of the substantially vertical region 124 of the plow 100 would be approximately one foot.

According to another embodiment, the extender wings 110 and 112 are extended so as to be positioned along the square channel 130 in a manner which places the inner most face of each of the extender wings 110 and 112 flush with each other. This embodiment would allow for the effective width of the plow 100 to be as narrow as approximately two feet.

According to a further embodiment, each of the extender wings 110 and 112 are capable of being fully extended about the square channel 130. According to this embodiment, the effective width of the plow 100 is able to be increased by approximately six feet. Depending on the overall size of the plow, the extender wings 110 and 112 are capable of providing an additional approximate six feet of width when fully extended about the square channel 130.

According to one embodiment, the extender wings 110 and 112 can be displaced independently from each other so as to result in a variable overall effective width of the plow 100. According to another embodiment, the extender wings 110 and 112 are placed equal distances from the center unit 120.

With reference to FIGS. 1 and 2, the plow 100 can move in a direction substantially perpendicular 102 to the surface of substantially vertical region 124, while bottom edge 180 can contact with or be very close to the surface to be plowed, e.g. sidewalk, street, etc. such that the snow to be plowed can initially come into contact with substantially vertical regions 124, 118 and 119. As the plow 100 can move in this direction, the snow can accumulate in the area as defined by the substantially vertical regions 124, 118 and 119 and the side containment plates 156 and 158. Thus, very little snow is displaced to either side of the plow 100. As the plow 100 can continue to move, the snow can continue to accumulate until it cannot be further contained by the center unit curved region 122, and extender wing curved regions 114 and 116.

When the plow 100 reaches a maximum capacity of snow that can be moved, the plow is able to then displace the snow to an appropriate location.

With continued reference to FIGS. 1 and 2, the plow 100 can move generally in the direction 102. According to one embodiment, the frame or other means by which the plow 100 is connected to the vehicle can allow the plow blade to self-adjust such that opposing distal ends of the plow 100 are placed at differing heights with respect to the ground below. Such self-adjustment may result in the plow 100 having one distal end raised higher off of the ground than the other. According to a further embodiment, the angle of elevation between extender wings 110 and 112 is able to be controlled via an automatic controller that may be incorporated into a plow hydraulic controller so as to optimize the efficiency of plowing.

With continued reference to FIGS. 1 and 2, the plow 100 can move generally in the direction 102 with a horizontal angle substantially defined as being a direction perpendicular to the surface of substantially vertical region 124. This horizontal angle can be adjusted by the frame or other attachment means by which the plow 100 is selectably attached to a vehicle by way of upper mounting brackets 190 and lower mounting brackets 192 on opposing distal ends of the plow 100 corresponding with extender wings 110 and 112. According to one embodiment, opposing distal ends of the plow 100 are able to be extended or retracted relative to the position of the vehicle to which they are attached. The orientation of the plow 100 is positioned such that the corresponding end of the plow 100 is now located at a distance further away from the vehicle. According to a further embodiment, the plow 100 is extended or retracted relative to the vehicle in such a manner that opposing distal ends of the plow blade remain in the same plane as one another.

According to one embodiment, the horizontal angle at which the plow 100 is able to extend or retract relative to the position of the vehicle to which the plow 100 is selectably attached by way of upper mounting brackets 190 and lower mounting brackets 192 may be controlled via an automatic controller (not shown). The automatic controller may be incorporated into a plow hydraulic controller so as to optimize the efficiency of plowing. According to one embodiment, the direction 102 will be along the same directional vector as the direction of the movement of the vehicle to which the plow 100 is attached by way of upper mounting brackets 190 and lower mounting brackets 192.

With continued reference to FIG. 2, the side containment plates 156 and 158 can be substantially parallel to each other and can be substantially orthogonal to vertical region 124. Additionally, the side containment plates 156 and 158 can be angled with respect to each other and the substantially vertical region 124 in order to gather more snow. In another embodiment of the invention, the plow has no side containment plates 156 and 158 and instead is a straight blade plow.

With continued reference to FIG. 2, the various components such as the center unit 120, extender wings 110 and 112, and side containment plates 156 and 158 can be constructed of materials including metal, plastic, or any combination of these or other appropriate materials.

Additional materials such as rubber, plastic, Teflon, etc. can be used for where the key components fit together, such as where the extender wings 110 and 112 can connect to center unit 120. Plow markers can be attached to the top of extender wings 100 and 112 so that an operator may be able to easily gauge where the edges of the plow are, even if the snow depth exceeds the height of the adjustable plow 100.

With reference to FIGS. 1 and 3, the plow 100 can move in a direction substantially perpendicular 102 to the surface of substantially vertical region 124, while bottom edge 180 can contact with or be very close to the surface to be plowed, e.g. sidewalk, street, etc. such that the snow to be plowed can initially come into contact with any combination of substantially vertical regions 124, 118 or 119. According to one embodiment, as the plow 100 moves in the direction substantially perpendicular 102 to the surface of substantially vertical region 124, snow is able to accumulate in the area as defined by the substantially vertical regions 124, 118 and 119. As the plow 100 continues to move, the snow is able to continue accumulating. The plow 100 is capable of continuing to accumulate snow until such a time when the level of accumulation of snow on the plow 100 reaches a point where it cannot be further contained by the center unit curved region 122, and extender wing curved regions 114 and 116.

According to this embodiment, there are no side containment plates. After achieving such a level of accumulation, snow is capable of being displaced about either side of the plow 100. The snow is able to be dispersed about the edges of the plow 100 by way of the extender wings 110 and 112. The extender wings 110 and 112 are able to be adjusted to any of the effective widths as described herein so as to enable the widest range of versatility of the plow 100. According to another embodiment, extender wing 110 is affixed with a containment plate so as to only allow for the displacement of snow about extender wing 112. The containment plate may be selectably attached to extender wing 110. According to a further embodiment, extender wing 112 is affixed with a containment plate so as to only allow for the displacement of snow about extender wing 110. The containment plate may be selectably attached to extender wing 112. The placement of a single containment plate about only of the extender wings 110 or 112 allows for the operator of the plow to dictate to which side the snow is displaced.

With continued reference to FIG. 3, according to this embodiment, the direction 102 can be adjusted manually, by a hydraulic actuator, or by any other means known by those skilled in the art such that the displaced snow is able to exit the plow 100 either to the side of extender wing 110, the side of extender wing 112, or the side of both extender wings 110 and 112. According to this embodiment, center unit 120 can consist of a straight-blade plow or the like.

According to one embodiment, the above-described adjustable snow plow may be combined with a salt spreader machine attached to the rear of the vehicle. Many snow removal professionals use such an arrangement. According to another embodiment, the extender wings 110 and 112 may be extended manually. According to this embodiment, the extender wings 110 and 112 may be locked into place with a locking mechanism. According to one embodiment, the locking mechanism consists of at least one locking pin. According to another embodiment, the locking mechanism consists of a series of locking pins.

As described above, the present disclosure has been described with preferred embodiments thereof and it is understood that many changes and modifications to the described embodiments can be carried out without departing from the scope and the spirit of the present disclosure that is intended to be limited only by the appended claims.

We claim:

1. An adjustable snow plow comprising:

a. a center unit, the center unit comprising a center unit blade having a top edge and a bottom edge and a lateral support member horizontally disposed between the top and bottom edge, wherein the center unit blade is vertically uncurved from the bottom edge to the lateral support member and comprises a vertically curved region between the lateral support member and the top edge;

b. at least one extender wing, the at least one extender wing comprising an exterior blade unit having a top edge and a bottom edge and a lateral support member horizontally disposed between the top and bottom edge, wherein the exterior blade unit is vertically uncurved from the bottom edge to the lateral support member and comprises a vertically curved region between the lateral support member and the top edge;

c. a square channel connected to said center unit, and;

d. at least one mounting bracket connected to said center unit;

wherein the at least one extender wing is connected to the center unit via the square channel, the at least one extender wing is able to slide horizontally about the square channel, and the at least one mounting bracket is pivotally attached to a frame on a first end, the second end of the frame being selectably attachable to a vehicle and wherein the adjustable plow is horizontally pivotal relative to the frame.

2. The adjustable snow plow of claim 1 wherein the at least one extender wing is adjustable by way of sliding horizontally about the square channel so as to change the effective width of the snow plow.

3. The adjustable snow plow of claim 1 wherein the horizontal movement of the at least one extender wing about the square channel is controlled by a hydraulic actuator.

4. The adjustable snow plow of claim 1 wherein the horizontal movement of the at least one extender wing about the square channel is controlled manually.

5. The adjustable snow plow of claim 1 wherein the blade of the plow is able to be raised and lowered relative to the ground located below the plow such that opposing distal ends of the plow remain in the same horizontal plane.

6. The adjustable snow plow of claim 1 wherein the blade of the plow is able to be raised and lowered relative to the ground located below the plow in a manner which causes one end of the plow to be raised higher than the opposing end, resulting in opposing distal ends of the plow to no longer remain in the same horizontal plane.

7. The adjustable snow plow of claim 1 wherein the blade of the plow is able to extend further away from, or retract closer to, the vehicle to which the plow is selectably attached such that the opposing distal ends of the plow remain in the same plane.

8. The adjustable snow plow of claim 1 wherein the blade of the plow is able to extend further away from, or retract closer to, the vehicle to which the plow is selectably attached, causing one end of the plow to be positioned at a distance further away from the vehicle than that of the opposing end, such that the opposing distal ends of the plow no longer remain in the same plane.

9. The adjustable snow plow of claim 1 wherein the at least one extender wing is affixed with at least one plow marker for identifying the relative location of the at least one extender wing.

10. The adjustable snow plow of claim 1 further comprising a containment plate that is able to be selectably attached to the at least one extender wing.

11. A method for plowing snow comprising the steps of:

a. selectably attaching an adjustable snow plow to a vehicle, said adjustable snow plow comprising:

a center unit, the center unit comprising a blade having a top edge and a bottom edge and a lateral support member horizontally disposed between the top and bottom edge, wherein the blade is vertically uncurved from the bottom edge to the lateral support member and comprises a vertically curved region between the lateral support member and the top edge;

at least one extender wing, the at least one extender wing comprising an exterior blade unit having a top edge and a bottom edge and a lateral support member horizontally disposed between the top and bottom edge, wherein the exterior blade unit is vertically uncurved from the bottom edge to the lateral support member and comprises a vertically curved region between the lateral support member and the top edge;

a square channel connected to said center unit, and;

at least one mounting bracket connected to said center unit;

wherein the at least one extender wing is connected to the center unit via the square channel, the at least one extender wing is able to slide horizontally about the square channel, and the at least one mounting bracket is pivotally attached to a frame on a first end, the second end of the frame being selectably attachable to a vehicle and wherein the adjustable plow is horizontally pivotal relative to the frame;

b. adjusting the at least one extender wing by way of the square channel connected to said center unit so as to achieve the desired horizontal width of the adjustable plow blade;

c. lowering the adjustable plow to the desired height relative to the ground beneath the plow blade;

d. directing the vehicle to which the adjustable plow is attached in a direction to which it is desired to remove snow, and;

e. displacing snow from the desired location about the side of the adjustable plow by way of at least one of the extender wings.

12. The method of claim 11 further comprising the step of adjusting the height of the plow relative to the ground such that the desired end of the plow is positioned at a height above that of the opposing distal end.

13. The method of claim 12 further comprising the step of adjusting the distance between the plow and the vehicle to which the plow is selectably attached such that one end of the plow is positioned further away from the vehicle than that of the opposing distal end.

14. The method of claim 11 wherein the adjustable plow further comprises at least one plow marker affixed to the at least one extender wing for identifying the relative location of the at least one extender wing.

15. The method of claim 11 wherein the horizontal movement of the at least one extender wing about the square channel is controlled by a hydraulic actuator.

16. The method of claim 11 wherein the horizontal movement of the at least one extender wing about the square channel is controlled manually.

17. The method of claim 11 wherein the adjustable plow further comprises a containment plate selectably attached to the at least one extender wing.

18. The adjustable snow plow of claim 1, wherein the at least one extender wing comprises a wing blade having a bottom edge and a top edge and a vertically uncurved region extending upward from the bottom edge and a vertically curved region extending downward from the top edge.

19. The adjustable snow plow of claim 18, further comprising at least one containment plate having a forward edge and a rearward edge, wherein the rearward edge is vertically uncurved extending upward from the bottom of the rearward edge and is vertically curved extending downward from the top.

20. The adjustable snow plow of claim 19, wherein the containment plate is pivotably attached to a side edge of the wing blade.

* * * * *